US005359852A

United States Patent [19]

Curran et al.

[11] Patent Number: 5,359,852

[45] Date of Patent: Nov. 1, 1994

[54] AIR FUEL RATIO FEEDBACK CONTROL

[75] Inventors: Judith M. Curran, Northville; Thomas R. Culbertson, Livonia; Douglas R. Hamburg, Bloomfield, all of Mich.

[73] Assignee: Ford Motor Company, Dearborn, Mich.

[21] Appl. No.: 117,590

[22] Filed: Sep. 7, 1993

[51] Int. Cl.[5] ..... F01N 3/20

[52] U.S. Cl. ..... 60/274; 60/276; 60/285; 123/703

[58] Field of Search ..... 60/274, 276, 285, 277; 123/691, 672, 703

[56] References Cited

U.S. PATENT DOCUMENTS

| | | | |
|---|---|---|---|
| 4,110,978 | 9/1978 | Nishimiya et al. . | |
| 4,130,095 | 12/1978 | Bowler et al. . | |
| 4,235,204 | 11/1980 | Rice . | |
| 4,707,085 | 11/1987 | Takanashi . | |
| 4,723,408 | 2/1988 | Nagai et al. . | |
| 4,761,950 | 8/1988 | Nagai et al. . | |
| 4,779,414 | 10/1988 | Nagai et al. . | |
| 4,796,425 | 1/1989 | Nagai et al. . | |
| 4,831,838 | 5/1989 | Nagai et al. . | |
| 5,168,700 | 12/1992 | Furuya | 60/285 |
| 5,172,549 | 12/1992 | Kako | 60/285 |
| 5,224,347 | 7/1993 | Yakabe | 60/285 |
| 5,228,286 | 7/1993 | Demura | 60/285 |
| 5,228,287 | 7/1993 | Kuronishi | 60/285 |
| 5,237,818 | 8/1993 | Ishii | 60/274 |

*Primary Examiner*—Ira S. Lazarus
*Assistant Examiner*—Daniel J. O'Connor
*Attorney, Agent, or Firm*—Peter Abolins; Roger L. May

[57] ABSTRACT

An air fuel ratio control system for an internal combustion engine having an electronic engine control module and an upstream and downstream exhaust gas oxygen sensor positioned in the engine exhaust gas stream. A first feedback loop includes the upstream EGO sensor. A second feedback loop includes a downstream EGO sensor and a trim bias signal to bias stored values provided from an air/fuel bias table. Such a biased signal is applied to an air fuel feedback controller which provides a feedback air fuel control signal to be applied to an open loop fuel controller.

5 Claims, 6 Drawing Sheets

AIR FUEL RATIO FEEDBACK CONTROL

BACKGROUND OF THE INVENTION

1. Field of the Invention

This invention relates to electronic engine controls.

2. Description of the Prior Art

It is known to use an electronic engine control module to control the amount of fuel being injected into an engine. In particular, it is known to use the output of an exhaust gas oxygen sensor as part of a feedback control loop to control air/fuel ratio. Typically, such an exhaust gas oxygen sensor is placed upstream of the catalyst which processes the exhaust gases. In some applications it is known to use a second exhaust gas oxygen sensor downstream of the catalyst, partly to serve as a diagnostic measurement of catalyst performance. With the presence of exhaust gas oxygen sensors both upstream of the catalyst and downstream of the catalyst, it would be desirable to develop an improved feedback air/fuel ratio control system using signals from both of these sensors.

Referring to FIG. 1, a prior art A/F control system 10 for an engine 11 uses feedback from an exhaust gas oxygen (EGO) sensor 12 installed after a catalyst 13 to trim the control point of a pre-catalyst A/F feedback loop including a pre-catalyst EGO sensor 14, a pre-catalyst feedback controller 15 and a base fuel controller 16. This post-catalyst feedback aids in (1) compensating for aging of pre-catalyst EGO sensor 14, and (2) maintaining the engine A/F in the catalyst window. Such performance improvements help reduce vehicle exhaust emissions. In known system designs, feedback from the post-catalyst sensor is used to slowly trim the A/F of the pre-catalyst loop by either changing the set point of the pre-catalyst EGO sensor or changing the relative values of the up-down integration rates and/or jump back values in the precatalyst control loop. A post-catalyst feedback loop includes a post-catalyst feedback controller 17 coupled between post-catalyst EGO sensor 12 and pre-catalyst feedback controller 15.

However, in such post-catalyst/pre-catalyst feedback systems (1) the pre-catalyst EGO sensor exhibits A/F offset errors which vary as a function of engine rpm and torque, and (2) the post-catalyst EGO sensor feedback signal is delayed due to oxygen storage in the catalyst. Since engine rpm and torque change continuously during dynamic operating conditions, the A/F correction applied to the pre-catalyst feedback loop under these conditions may not occur at the same rpm/torque point which generated the feedback signal, and the A/F offset error will consequently be incorrectly trimmed. As a result, such post-catalyst/pre-catalyst feedback systems compensate for aging of the pre-catalyst EGO sensor on the average basis. They do not maintain the engine A/F in the catalyst window at all rpm-torque operating points of the engine. It would be desirable to have a system to not only compensate for pre-catalyst EGO sensor aging, but to also maintain the engine A/F in the catalyst window for all rpm/torque operating conditions.

It is also known that U.S. Pat. No. 4,110,978 teaches (in FIG. 5) an EGO sensor output divided into three regions depending on the voltage output of the sensor for controlling the opening area of an air bleed 42 (FIG. 6) not, as in this invention, for learning control. Region II corresponds to a steady running condition of the engine, whereas Region I is an accelerating running condition and Region III is an idling or slowing-down running condition of the engine. As shown in FIG. 6, the EGO sensor output voltage $e_1$–$e_3$ is compared in a comparator block 35 (with voltages $e_o$ representing the three regions) for controlling a transistor 36 which in turn controls a valve 37 for adjusting the amount of air through the air passage 42 and, consequently, the A/F ratio. The purpose of providing variable amounts of air through the air bleed passage 42 as a function of the output of the EGO sensor is to force the three-way catalytic converter to operate in either a reducing state or an oxidizing state depending on the running condition of the engine as indicated by the output of the EGO sensor.

SUMMARY OF THE INVENTION

This invention includes using two exhaust gas oxygen sensors (HEGO), one located upstream of a catalyst and one downstream of the catalyst, wherein the downstream HEGO sensor provides a feedback signal for learning control of the air fuel control system. The HEGO bias term learns based on the rear HEGO voltage. The bias term is used in an air fuel ratio limit cycle control to shift the air fuel control to operate in a catalyst window.

DETAILED DESCRIPTION OF THE INVENTION

Figure 2:
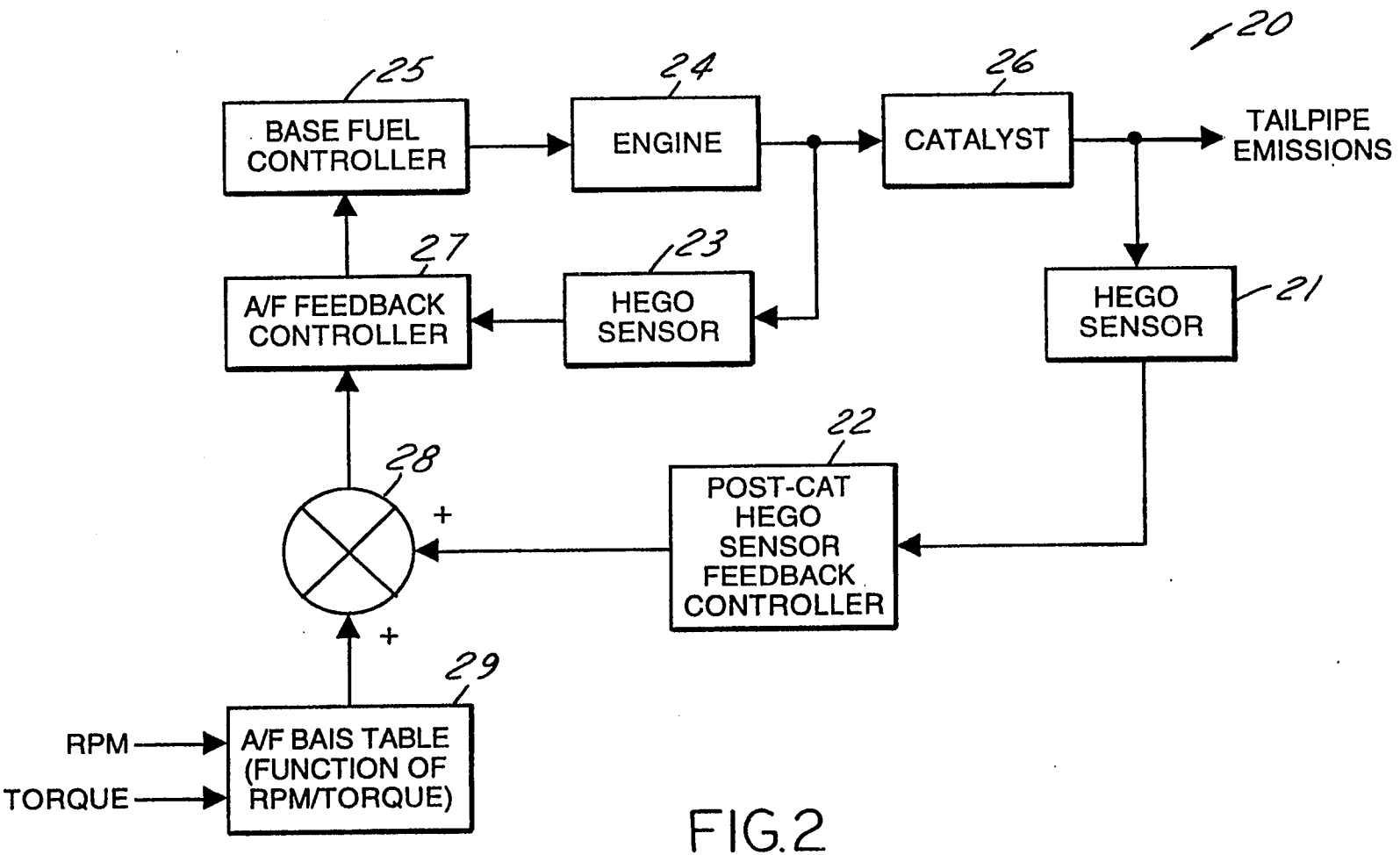
FIG. 2 is a block diagram of a pre-catalyst/post-catalyst air fuel ratio feedback control system in which a post-catalyst exhaust gas oxygen sensor provides a feedback signal for learning control of the air/fuel ratio control system, in accordance with an embodiment of this invention.
Figure 4A:
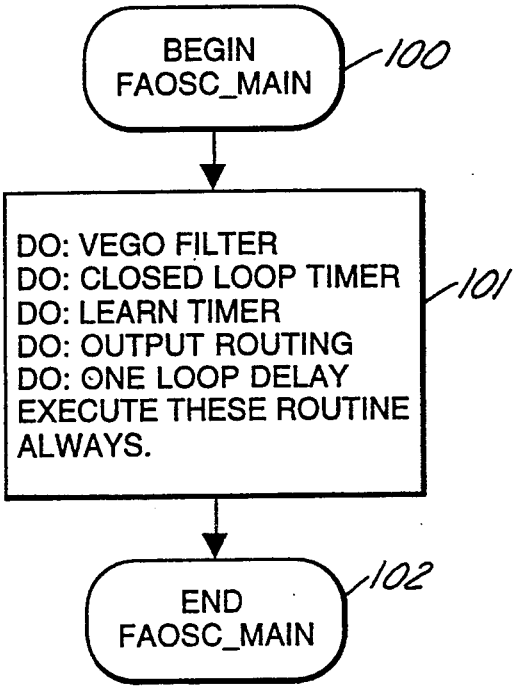
FIG. 4 is a logic flow diagram explaining the generation of the R_BIAS term, which is the output of the post catalyst HEGO sensor feedback controller.
Figure 4B:
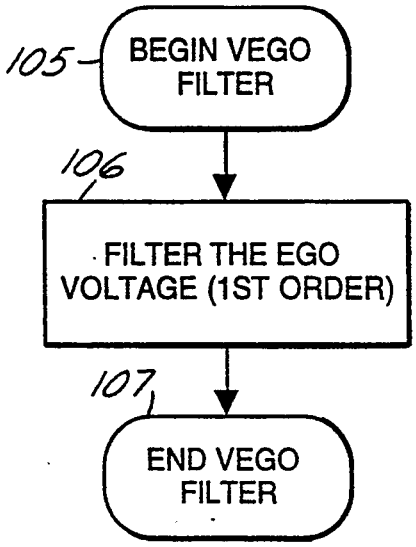
Figure 4C:
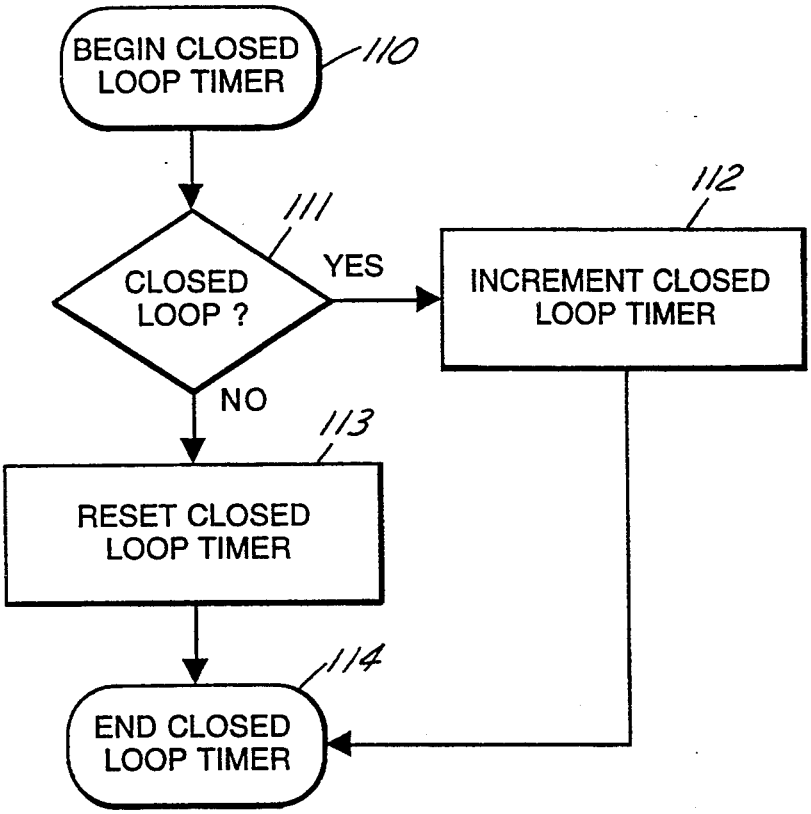
Figure 4D:
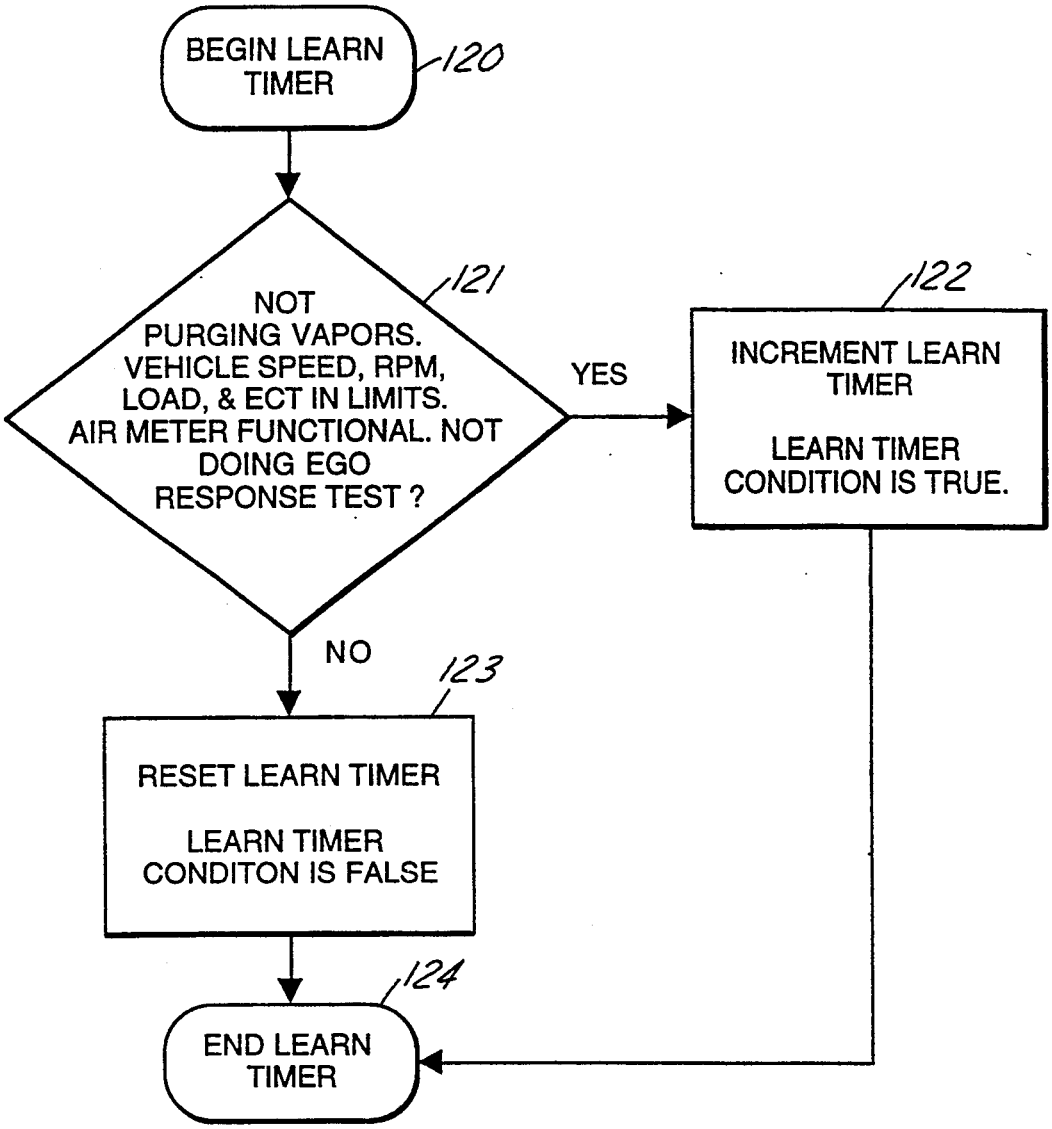
Figure 4E:
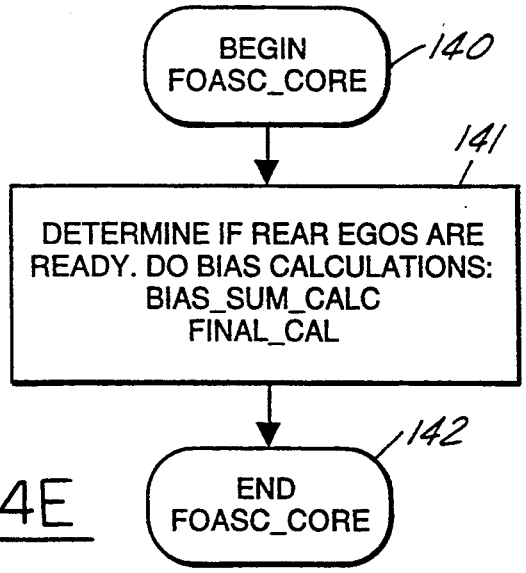
Figure 4F:
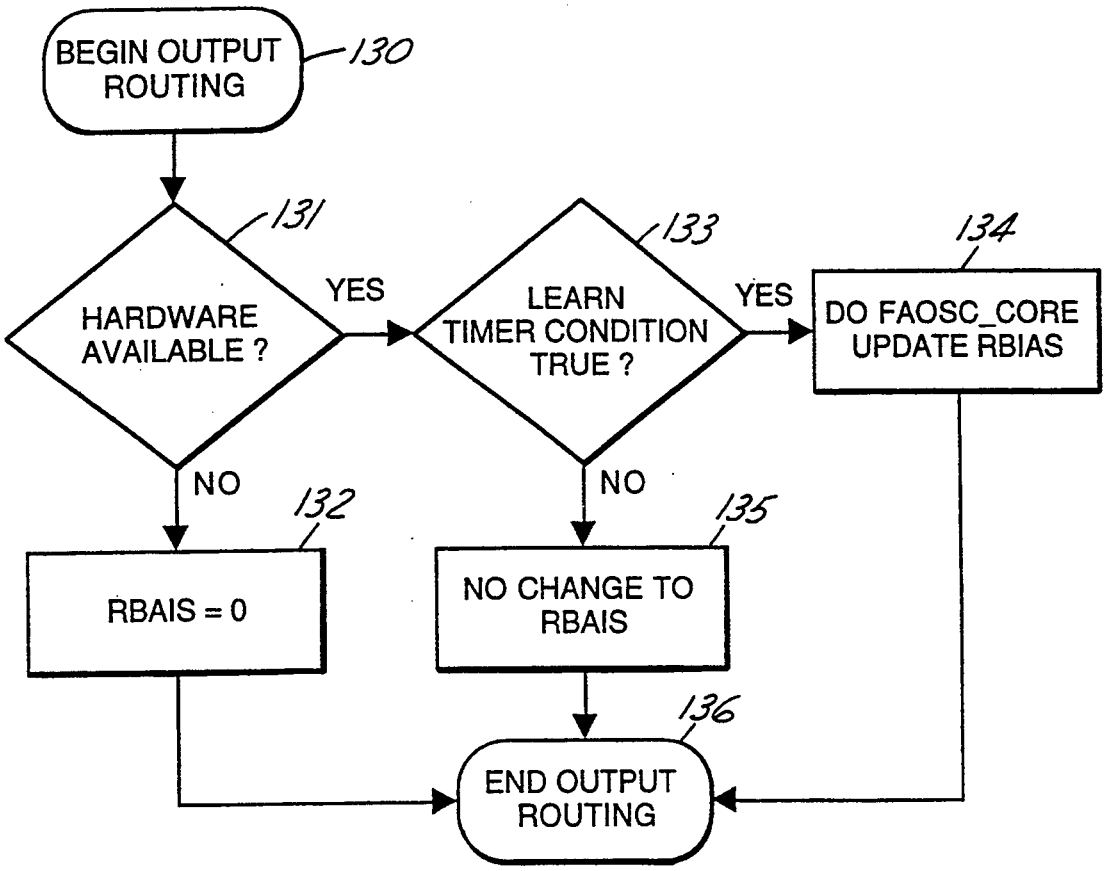
Figure 4G:
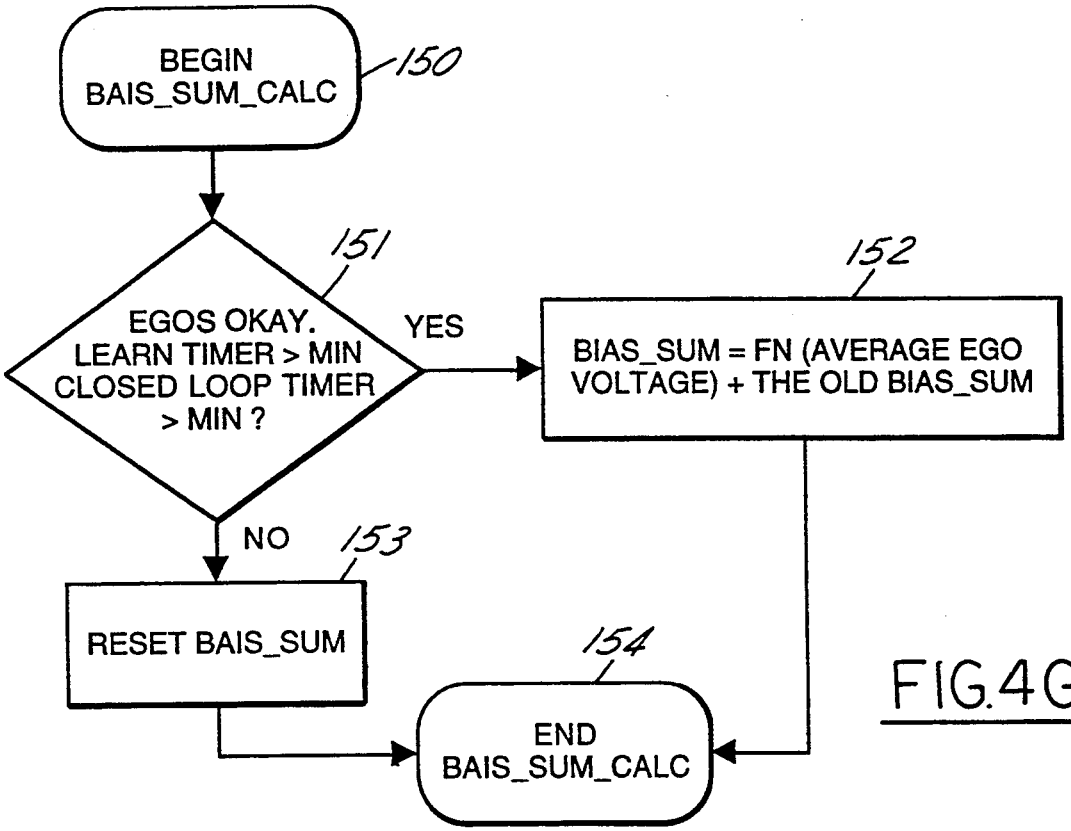
Figure 4H:
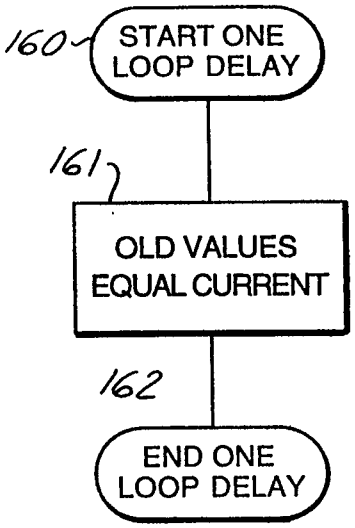
Figure 4I:
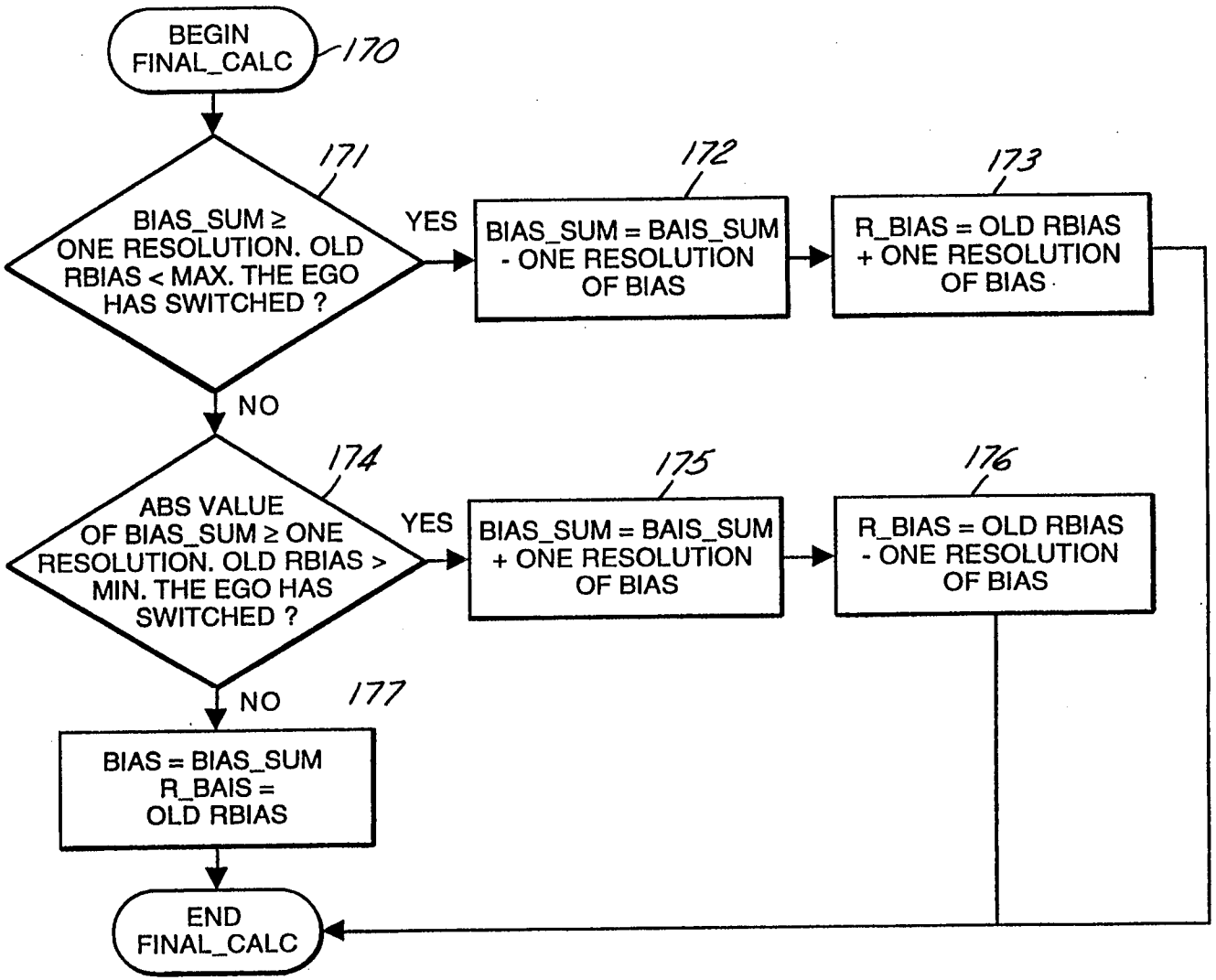

Referring to FIG. 2, an air/fuel ratio control system 20 in accordance with an embodiment of this invention uses feedback from a post-catalyst EGO sensor 21 to appropriately bias existing values which are stored in an A/F bias table 29. A base fuel controller 25 is coupled to provide an input to an engine 24. Exhaust from the engine is applied to a catalyst 26. Upstream of catalyst 26, an exhaust gas oxygen (EGO) sensor generates a pre-catalyst EGO sensor feedback signal. Downstream of catalyst 26, an exhaust gas oxygen sensor 21 generates a post catalyst EGO sensor feedback signal. Downstream HEGO sensor 21 provides a feedback signal for learning control of A/F ratio control system 20.

With reference to FIG. 2, A/F ratio feedback control system 21 includes an A/F bias table 29 which supplies, through a summer 28, a bias signal to an A/F feedback controller 27 for changing the integrator gain of the proportional integral (PI) controller (A/F Feedback Controller 27) as a function of engine rpm and torque of the engine. The bias signal corrects for the different operating characteristics of the front HEGO sensor at different engine rpms and torque. Summer 28 also receives a signal from a rear HEGO sensor feedback controller 22, which has the effect of modifying the bias table signal. This moves the table values up or down and is done primarily to correct for aging of upstream HEGO sensor 23.

Figure 1:
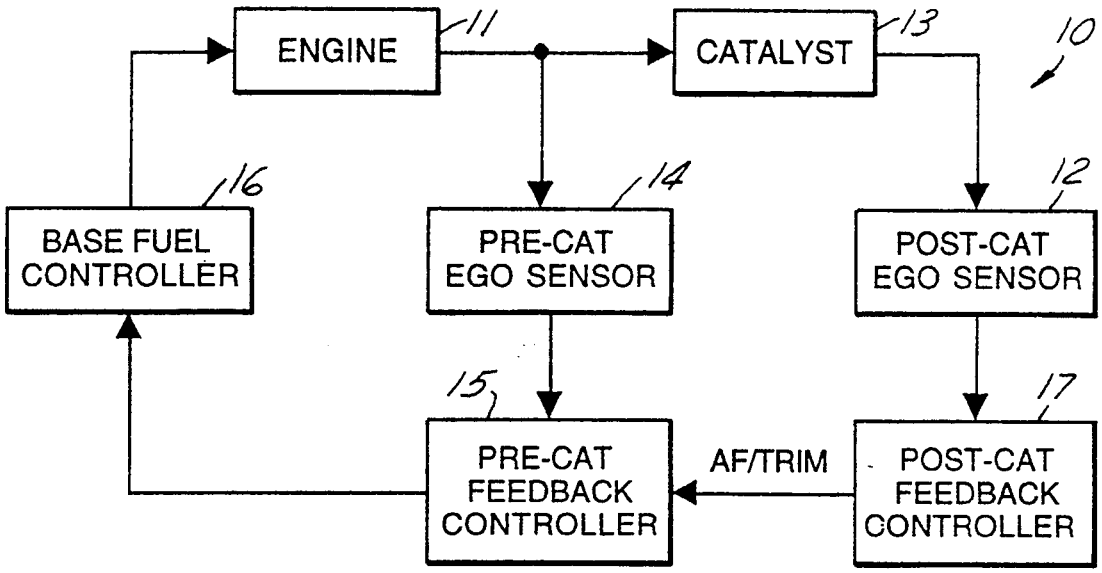
(PRIOR ART) FIG. 1
FIG. 1 is a block diagram of a pre-catalyst/post-catalyst air fuel ratio control feedback system in which post-catalyst feedback provides air fuel ratio trim to a pre-catalyst feedback, in accordance with the prior art.
Figure 3:
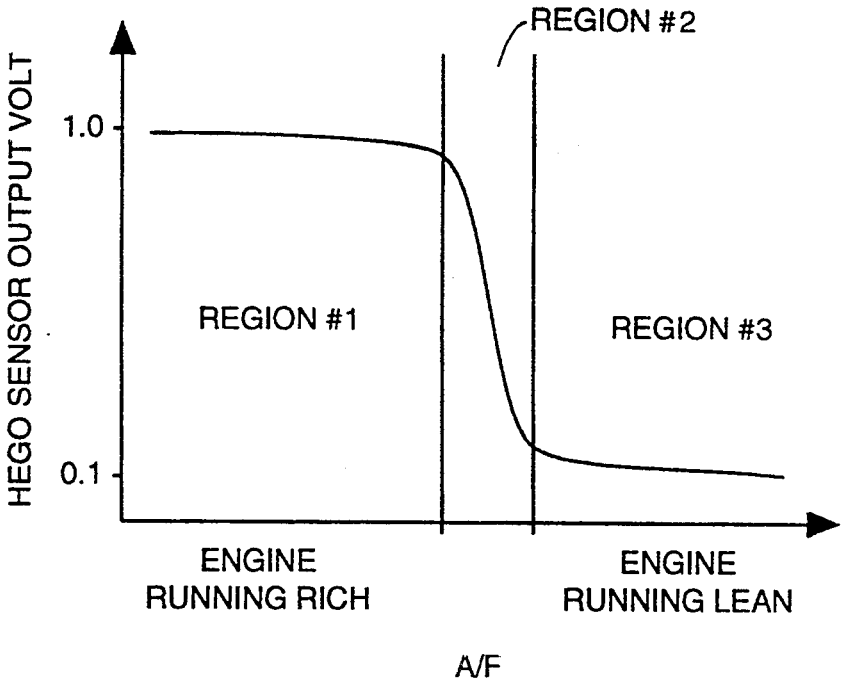
FIG. 3 is a graphical representation of HEGO sensor voltage output versus air fuel ratio showing three regions of operation in accordance with an embodiment of this invention.

Learning control is provided by a "tri-state" output of rear HEGO sensor 21, as shown in FIG. 3. Both front and rear HEGO sensors (23 and 21) exhibit, characteristics illustrated by the graph of voltage plotted against A/F ratio, in which there are three regions of the HEGO sensor output signal, i.e., a rich region #1, a deadband region #2 and a lean region #3. When the signal from rear HEGO sensor 21 is operating in the deadband region #2, learning is suspended. Learning occurs both in regions #1 and #3. In other words, the rear HEGO sensor feedback loop corrects for the front HEGO sensor's aging or false outputs on either side of the deadband, but does not correct the bias table when operating within the deadband. As indicated above, the rear HEGO sensor loop functions to move air fuel bias table 29 in a direction to correct for erroneous front HEGO sensor control by learning the long-term aging characteristics of the front HEGO sensor.

A/F bias table 29 is a multi-cell table which contains correction values that are used to shift the closed-loop A/F control point of an engine 24 as a function of engine rpm and torque. Various methods can be used to actually shift the engine A/F ratio. These methods include changing the switch point reference of a pre-catalyst EGO sensor 23, changing the up/down integration rates and/or jump back values of the pre-catalyst feedback loop, or changing the relative lean-to-rich and rich-to-lean switching delays associated with pre-catalyst EGO sensor 23. A feature of the invention is the method by which the values of the rpm/torque cells of A/F bias table 22 are changed for updating. To be specific, post catalyst HEGO sensor feedback controller 22 provides a voltage bias signal to bias the values in rpm/torque cells in air fuel table 29 so as to provide updating by the feedback signal from post-catalyst EGO sensor 21.

This invention includes a method to bias the A/F bias values in the various cells of A/F bias table 29. Specifically, the output of post-catalyst EGO sensor 21 is processed by a voltage comparator circuit which will produce a "rich" signal when the engine A/F is on the rich side of the catalyst window. When a "rich" signal is produced, the post-catalyst feedback controller will slowly ramp a lean correction into a positive input of summer 28. Similarly, when a "lean" signal is produced, the feedback controller will slowly ramp a rich correction into the positive input of summer 28. Note that applying the feedback correction in this manner is actually just a way to implement low gain integral feedback from post-catalyst EGO sensor 21.

Often in engine control systems, the actual signal processing is performed digitally. As such, the post-catalyst feedback could be implemented in several different ways. One example of how the disclosed invention would work and how it could be implemented is now described.

Suppose that engine 24 is operating at a particular rpm and torque point which causes the A/F to be on the rich side of the catalyst window. After sufficient time has passed to account for delay through catalyst 26, post-catalyst EGO sensor 21 will produce a "rich" signal corresponding to the rpm/torque operating point.

The type of post-catalyst feedback discussed so far is pure integral control which uses the rich/lean output signals from a post-catalyst EGO sensor comparator circuit as its input. This is the conventional method of feedback which is employed when switching EGO sensors are used to indicate whether A/F is rich or lean of stoichiometry. It may be advantageous to use a tri-state feedback in order to avoid low-frequency fluctuations in the engine A/F. It should also be noted that it may be advantageous to incorporate correction for EGO sensor temperature effects. Such temperature correction would be used to offset any closed-loop A/F shifts that occur with some EGO sensors when exhaust gas temperature changes. FIG. 3 shows tri-state post catalyst feedback characteristics of A/F ratio versus HEGO sensor output voltage in FIG. 2.

The term EGO sensor refers to exhaust gas oxygen sensors in general. As such, heated exhaust gas oxygen (HEGO) and universal exhaust gas oxygen (UEGO) sensors could be used equally well. Furthermore, the invention could be advantageously applied to feedback systems using post-catalyst emission sensor arrays. Various other exhaust gas emission sensors can be used to detect exhaust gas components such as hydrocarbons or oxides of nitrogen.

Referring to FIG. 2, the signal provided from summer 28 to air fuel feedback controller 27 is Bias - Gx and provides a bias shift for the air fuel ratio limit cycle. In equation form:

BIA_ Gx=FN 1353A (N, Load) *
EGO_BIAS_MLT +R_BIAS×

The terms FN 1353A (N, Load) * EGO_BIAS_MLT are calibrated and therefore predetermined. The last term, R_ BIAS, is learned from rear EGO sensor 21 and is applied from post catalyst HEGO sensor feedback controller 22 to a positive input of summer 28.

CALCULATION OF R_BIAS$_x$ TERM

Referring to FIG. 2, calculation of the R_bias term, or the trim bias term, which is the output from block 22 to summer 28 although FIG. 2 shows only one fore EGO sensor (23) and one aft EGO sensor (21) it is possible to have a dual bank system wherein, if the engine has two banks, such as a $V_8$, then each bank of four cylinders has a fore EGO sensor and an aft EGO sensor. These are typically known as banks 1 and 2.

The following definitions are used in connection with explanation of the generation of the R_bias term.

DEFINITIONS

INPUTS

Registers:

BG_TMR=Background loop timer.

BIAS_SUM1=Rear EGO BIAS sum register for bank one.

BIAS_SUM2=Rear EGO BIAS sum register for bank two.

ECT=Engine Coolant Temperature, deg. F.

EGO12FMFLG=EGO12 failure mode flag; 1≧EGO12 failed.

EGO22FMFLG=EGO22 failure mode flag; 1 ≧EGO22 failed.

LOAD=Universal LOAD as ratio of air charge over standard.
N=Engine speed, RPM.
PCOMP_DISP=PCOMP_PPM in display form.
R_BIAS1=Rear BIAS trim for bank 1.
R_BIAS2=Rear BIAS trim for bank 2.
RBIAS_CL_TMR=Time since entry into closed loop, sec.
RBIAS1_EGOSW=Number of EGO switches since last R_BIAS1 update.
RBIAS2_EGOSW=Number of EGO switches since last rear BIAS.
RBIAS_LN_TMR=Time since entry conditions to learn have been met.
TCSTRT - Coolant temperature at start.
VEGO12=Bank1 downstream HEGO voltage.
VEGO12_BAR=Filtered bank1 downstream HEGO voltage.
VEG022=Bank2 downstream HEGO voltage.
VEGO22_BAR=Filtered bank2 downstream HEGO voltage.
VSBAR=Filtered vehicle speed.
Bit Flags
DS LEAN1=Flag used by the downstream EGO monitor to signal when a lean A/F excursion is required for bank1.
DS LEAN2=Flag used by the downstream EGO monitor to signal when a lean A/F excursion is required for bank2.
DS_RICH1=Flag used by downstream EGO monitor to signal when a rich A/F excursion is required for bankl.
DS_RICH2=Flag used by the downstream EGO monitor to signal when a rich A/F excursion is required for bank2.
MFMFLG=MAP/MAF FMEM flag.
OLFLG=Open Loop Flag.
PCOMP ENA=PCOMP strategy enabled flag; 1≦PCOMP is enabled; adaptive fuel disabled.
REGOFL1=Rear EGO-1 flag.
Calibration Constants
BIAS_G_RES=Resolution of BIAS G.
FN334(VEGOXX_BAR)=BIAS/MIN trim as a function of rear HEGO voltage.
FN360(TCSTRT)=Time since crank when it is o.k. to use rear HEGO to trim. TLE HEGO_CONFIG=HEGO configuration register.
RBIAS_CL_TM=Time required in closed loop before BIAS trimming is allowed.
RBIAS_ECT_MN=Minimum ECT required to use rear EGO for front EGO trimming.
RBIAS_ECT_MX=Maximum ECT allowed to use rear EGO for front EGO trimming.
RBIAS_LD_MAX=Maximum LOAD allowed to use rear EGO to learn BIAS.
RBIAS_LD_MIN=Minimum LOAD required to use rear EGO to learn BIAS.
RBIAS_LN_TM=Time required in a speed/-LOAD condition to start learning.
RBIAS_MAX=Maximum allowable value of R_BIAS.
RBIAS_MIN=Minimum allowable value of R_BIAS,
RBIAS_N MAX=Maximum RPM allowed to use rear EGO to learn BIAS.
RBIAS_N_MIN=Minimum RPM required to use rear EGO to learn BIAS.
RBIAS_PCOMP=Maximum allowed PCOMP value to use rear EGO for front EGO trimming.
RBIAS_VS_MIN=Minimum vehicle speed required before BIAS trimming is allowed.
TC_VEGO_FA=Time constant for rear HEGO filter to be used in fore/aft control.

OUTPUTS

Registers
RBIAS_CL_TMR=See above,
RBIAS_LN_TMR=See above,
RBIAS1_EGOSW=See above,
BIAS_SUM1=See above,
BIAS_SUM2=See above,
R_BIAS1=See above,
R_BIAS2=See above,
Bit Flags
DS_LEAN1=See above.
DS_RICH1=See above.

The main steps for calculating R BIAS as shown in FIG. 4 starting at block 100 to begin the sequence, block 101 which indicates the various steps in the sequence and block 102 which indicates the end of the sequence. The first step of block 101 is shown in greater detail at blocks 105, which indicates the beginning to filter the voltage from the EGO sensor, block 106 which filters the EGO sensor voltage and block 107 which ends the EGO sensor filtered voltage sequence. Filtering is done by a rolling average filter wherein the new value is equal to the sum of the quantities of the latest piece of data times the weighting factor plus the previous average times the quantity 1 minus the weighting average. Thus, depending upon the size of the weighting factor, the rolling average is more or less influenced by the previous average.

The second step of block 101, doing a closed loop timer is shown in more detail beginning at block 110 wherein there is begun a closed loop timer. This is done to insure the catalyst is operating in a stable condition. Logic flow from block 110 goes to a decision block ill where it is asked if this operation of the control system is in closed loop. If yes, logic flow goes to a block 112 where there is an increment of the closed loop timer. If no, logic flow goes to a block 113 where there is a reset of the closed loop timer. Logic flow from both blocks 113 and 112 goes to a block 114 wherein there is an end to the closed loop timer. The timer counts the time in closed loop. This is the time in closed loop which is required to determine if the system is ready, i.e. stable, for closed loop rear control.

The third "Do" in block 101 is to learn the timer. Referring to block 120 the learning timer is begun. Logic flow then goes to a decision block 121 where a number of conditions are determined to determine if there can be any learning of any front HEGO characteristics from the rear HEGO. That is, all these conditions must be true: purge flow must be low; vehicle speed must be medium or high, indicating a cruise condition for stability purposes; engine RPM must be within an appropriate window; engine load must be within the appropriate window; engine coolant temperature must be within the appropriate window; the air meter must be working; and the system cannot be doing a HEGO monitor test, such as an onboard diagnostic test. If all these conditions are true, logic flow goes to a block 122 wherein there is an increment of learn timer and the learn timer condition is true. If any of the conditions are not true in block 121, logic flow goes to a block 123 wherein the learn timer is reset and the learn timer condition is established as false. Logic flow from blocks 123 and 122 both go to a block 124 where there is an end to the learn timer. The purpose of this sequence is to insure a stable catalyst operating condition.

The fourth "Do" in block 101 is output routing which is further explained at block 130 which begins output routing. Logic flow from block 130 goes to a decision block 131 wherein it is asked is the hardware available. If not, logic flow goes to a block 132 where the R_bias term is set to zero and then logic flow goes to a block 136 where there is an end to output routing. If hardware is available at block 131, yes, logic flow goes to a decision block 133 where it is asked to learn the timer condition true. If yes, logic flow goes to a block 134 where the FAOSC_CORE is done and the R_BIAS is updated if required. For example, if rear EGO sensor 21 is in the deadband there will be no updating. If no, logic flow goes to a block 135 where there is no change to the R_BIAS. Logic flow from both block 134 and block 135 goes to block 136 which is the end of output routing.

Referring to block 140, it is begun to FAOSC_CORE, which is an abbreviation for fore aft oxygen sensor control. Logic flow then goes to a block. 141 where it is determined if the rear EGOs are ready. That is, the rear EGO is checked on each bank, to verify it has been check for functionality and it is working. Logic flow from block 141 goes to a block 142 where there is an end to the FOASC_CORE.

If the rear HEGO sensor is operational, it is OK for the system to learn from the EGO sensor and, if the system has been in closed loop long enough, it is OK to use the rear EGO sensor to learn front HEGO characteristics. To learn front HEGO characteristics, the rear HEGO filter voltage is entered into a transfer function to determine a learning rate, the amount of BIAS learned per minute. This rate is multiplied by the time which has passed since the last learning. This value is then equal to the BIAS learned during this computation pass. These BIAS amounts for each pass are added into a register called BIAS_SUM1, for engine bank1, and BIAS_SUM2, for engine bank2.

Logic flow for beginning the BIAS_SUM calculation starts at block 150. Logic flow for block 150 goes to a decision block 151 where it is asked if the EGOs are OK and if the learning timer is greater than the predetermined minimum and the closed loop timer is greater than the predetermined minimum. If yes, logic flow goes to a block 152 wherein the BIAS_SUM is equal to the last computed BIAS_SUM plus the old BIAS_SUM. If no, logic flow goes to reset the BIAS SUM term. Logic flow from both blocks 152 and 153 goes to block 154 where there is an end to the BIAS calculation.

If the value of the $BIAS_SUM_x$ term gets large enough, negatively or positively, the actual term which is used to modify the limit cycle, $R_BIAS_x$ is modified. The resolution of $BIAS_SUM_x$ is much smaller than the resolution of $R_BIAS_x$. This is to allow slow learning and thus avoid instability. If the rear HEGO stays on one side of stoichiometry for a time period, the register $BIAS_SUM_x$starts to increment. After many background computational passes, the value in $BIAS_SUM_x$ will be large enough to shift the LAMBSE limit cycle by incrementing the term $R_BIAS_1x$. The $BIAS_SUM_x$ is then cleared and restarted. This is continued until the system stabilizes. The rear HEGO voltage stays within the dead band, $BIAS_SUM_x$ and $RBIAS_x$ do not update.

The fifth "Do" in block 101 is to do a one loop delay. This is shown at block 160 wherein there is a start of a one loop delay. Logic flow from block 160 goes to block 161 wherein the old values are set equal to the current values. Logic flow then goes to a block 162 wherein there is an end to the one loop delay.

Referring to block 170 there is begun the final calculation. Logic flow from block 170 goes to a decision block 171 wherein the BIAS_SUM term in interrogated whether it is greater than or equal to one resolution and the old R_BIAS is less than a maximum clip and the EGO has switched. If yes, logic flow goes to a block 172 wherein the BIAS_SUM is set equal to the former BIAS_SUM less one resolution of the BIAS. Logic flow then goes to a block 173 wherein the R_BIAS is set equal to the old R_BIAS plus one resolution of BIAS. If the decision at block 171 is no, logic flow then goes to a decision block 174 wherein it is checked whether the ABS value of BIAS_SUM is greater than or equal to one resolution. It is also checked if the old R_BIAS is greater than the minimum, and the EGO has switched. If yes, logic flow goes to a block 175 wherein the BIAS_SUM is set equal to the old BIAS_SUM plus one resolution of BIAS. Logic flow then goes to a block 176 wherein the R_BIAS is set equal to the old R_BIAS less one resolution of BIAS. If the decision at block 174 is no, logic flow goes to a block 177 wherein a BIAS_SUM is set equal to the old BIAS_SUM and the R_BIAS is set equal to the old R_BIAS. Logic flow from blocks 173,176 and 177 goes to a block 178 wherein there is an end to the final calculation.

Referring to FIG. 2, after the R_BIAS term is calculated it is applied to summer 28 to be summed with the output of the base BIAS air/fuel BIAS table block 29. The output of summer 28 is a BIAS_GX term. The BIAS_GX term provides a BIAS or a shift for the use of the LAMBSE limit cycle. The BIAS_GX term is then applied to air/fuel feedback controller 27. The BIAS_G term is the amount of BIAS from stoichiometry. The BIAS term is used to make the limit cycle operate in an average air/fuel ratio rich or lean of stoichiometry. For zero BIAS, the average air/fuel ratio is stoichiometry.

Various modifications and variations will no doubt occur to those skilled in the arts to which this invention pertains. Such variations which basically rely on the teachings through which this disclosure has advanced the art are properly considered within the scope of this invention.

What is claimed is:

1. A method of controlling air/fuel ratio using electronic engine controls for an internal combustion engine including the steps of:

providing a pair of sensor means for characterizing at least one constituent of an exhaust gas in an exhaust stream from the internal combustion engine, a first sensor means being positioned upstream of a catalyst and a second sensor means being positioned downstream of the catalyst;

providing a control module having an input connected to the upstream and downstream sensors means and an output connected to the actuators controlling the engine, as to establish a first feedback loop including the first upstream sensor means and a second feedback loop including the second downstream sensor means;

providing an air/fuel ratio bias table in said first feedback loops to alter the transfer function of said first feedback loop; and using an output of said second downstream sensor means to bias the output of the air/fuel bias table thereby compensating the first and second air/fuel ratio feedback loops for aging of said first upstream sensor means and providing a capability to stay within a catalyst window of operation as a function of engine speed and torque operating points, including the steps of:

determining a purge flow is low;

determining vehicle speed is above a predetermined low speed and has a predetermined amount of stability;

determining that the engine speed, load and coolant temperature are within a predetermined window;

determining that an air meter associated with the internal combustion engine is properly working; and determining that the second downstream sensor means in a non-test mode of operation.

2. A method as recited in claim 1 in which said sensor means is an exhaust gas oxygen (EGO) sensor and further comprising using a tri-state feedback in said first and/or second feedback loops in order to avoid low frequency fluctuations in the air/fuel ratio control system.

3. A method as recited in claim 2 wherein said second sensor means is an exhaust gas emission sensor.

4. A structure for controlling air/fuel ratio of an electronic engine control system including:

a first upstream exhaust gas oxygen sensor positioned in front of a catalyst in the exhaust gas of the engine;

a second exhaust gas oxygen sensor, downstream from the said exhaust gas oxygen sensor and catalyst, coupled to the exhaust gas stream of the engine;

a post catalyst sensor feedback controller means coupled to the said second EGO sensor for providing a trim bias signal for shifting the A/F trim values;

an air/fuel bias table storing an air/fuel trim amount as a function of rpm and torque; and providing a base air/fuel bias signal; a summer means coupled to said air/fuel bias table update means for receiving said air/fuel bias signal and to said post catalyst sensor feedback controller for receiving the trim bias signal;

an air/fuel feedback controller coupled to the summer for receiving a combined bias signal and for generating a processed bias signal;

a base fuel controller coupled to the engine for controlling the introduction of fuel into the engine and coupled to the air fuel feedback controller for receiving the processed bias signal; and said post-catalyst sensor feedback controller for generating the trim bias including:

means for determining low purge flow, sufficiently high vehicle speed, a predetermined range of magnitudes for engine speed, load, and coolant temperature, an operational air meter, a non-diagnostic condition.

5. A structure for controlling air/fuel ratio of an electronic engine as recited in claim 4 wherein said post-catalyst sensor feedback controller for generating the trim bias further includes:

a transfer function means for determining a learning rate for the bias.

* * * * *